United States Patent [19]

Haubner et al.

[11] 3,963,015

[45] June 15, 1976

[54] SIMPLIFIED AUTOMATIC ADVANCE IGNITION SYSTEM FOR AN INTERNAL COMBUSTION ENGINE

[75] Inventors: Georg Haubner, Berg; Walter Hofer; Werner Meier, both of Schwabach, all of Germany

[73] Assignee: Robert Bosch G.m.b.H., Stuttgart, Germany

[22] Filed: Dec. 4, 1973

[21] Appl. No.: 421,539

[30] Foreign Application Priority Data

Dec. 14, 1972 Germany ..... 2261156

[52] U.S. Cl. ..... 123/148 CC; 123/148 E; 123/149 C

[51] Int. Cl.[2] ..... F02P 1/00

[58] Field of Search ..... 123/149 C, 148 MC, 148 E, 123/149 F; 315/209 M, 218, 225

[56] References Cited

UNITED STATES PATENTS

| | | | |
|---|---|---|---|
| 3,326,199 | 6/1967 | McMillen | 123/148 E |
| 3,484,677 | 12/1969 | Piteo | 123/148 E |
| 3,504,373 | 3/1970 | Strelow | 315/218 |
| 3,524,438 | 8/1970 | Janisch | 123/149 C |
| 3,630,185 | 12/1971 | Struber | 123/148 MC |
| 3,646,667 | 3/1972 | Janish | 123/149 C |
| 3,704,701 | 12/1972 | Struber et al. | 123/148 MC |
| 3,768,455 | 10/1973 | Imhof | 123/148 E |
| R27,477 | 9/1972 | Piteo | 123/148 E |

*Primary Examiner*—Charles J. Myhre
*Assistant Examiner*—Paul Devinsky
*Attorney, Agent, or Firm*—William R. Woodward

[57] ABSTRACT

In an ignition system in which the spark coil is wound right on the magneto armature and the spark is produced by electronic interruption of a short circuit across the primary winding, the first of a succession of rectified half waves applied to the electronic circuit unit has its amplitude reduced either by insertion of a circuit component in one half wave path of the rectifier to provide damping, or by the configuration of the armature core, or both. The magneto rotor has a U-shaped permanent magnet, the pole faces on the end of the legs of which are rotated past opposed pole faces of the armature core, which has the desired effect if the latter is of asymmetric U-shape or of symmetrical E-shape.

2 Claims, 6 Drawing Figures

SIMPLIFIED AUTOMATIC ADVANCE IGNITION SYSTEM FOR AN INTERNAL COMBUSTION ENGINE

This invention relates to an ignition system for internal combustion engines of the type in which the armature of a magneto generator also operates as a spark coil and accordingly has a primary and a secondary winding, with the secondary connected to at least one spark plug and with the primary connected to an electronic circuit that normally short circuits the primary and is arranged to open the short circuit at the ignition timing moment.

In order to provide for operation of the internal combustion engine under optimum power development, circuits have been provided for advancing the spark, i.e. timing the ignition at an earlier point of the engine cycle, at high engine speed. It is also known to improve the combustion of the fuel by the provision of multiple spark generating pulses at the time of ignition. In order to obtain these effects, however, relatively expensive circuits have been necessary which normally involve the provision of a spark coil in an ignition current circuit and a control armature in a control current circuit, the latter controlling an electronic switching means in the ignition current circuit. On the other hand, simple ignition systems are known which, by dispensing with spark advance and multiple ignition features get along with only a single ignition armature instead of separate spark coil and control armatures.

It is an object of the invention to provide for spark advance and multiple ignition, while at the same time so simplifying the circuit that only a single armature is needed.

SUBJECT MATTER OF THE PRESENT INVENTION

Briefly, by the geometric configuration of the ferromagnetic core of the ignition armature and/or provision of electronic damping of the first of a succession of at least two diode-rectified voltage half waves generated by the ignition armature, the first half wave of the succession is caused to have a lower peak voltage than the succeeding half wave, so that at low speeds of the engine the interruption of the short circuit across the primary winding of the armature will not take place on the first rectified half wave, but will take place on the succeeding one, whereas at higher speed it will take place on the first half wave, providing spark advance, and also on the succeeding half wave or half waves, providing multiple ignition.

Particularly effective operation according to the invention is obtained when the ferromagnetic core of the ignition armature of the magneto generator has an E-shaped configuration with suitable pole faces provided on each of the legs of the armature and when the permanently magnetized rotor driven by the engine to excite the aforesaid armature has at least one U-shaped magnet system comprising a permanent magnet, likewise provided with pole faces on the legs of the magnet system, so disposed that the pole faces of the U-shaped magnet system of the rotor, or of each of them if there is more than one, are opposite each pair of adjacent pole faces of the armature core once in every revolution of the magneto generator (and hence also once for every revolution of the rotor).

The invention is described by way of particular embodiments with reference to the annexed drawings, in which.

Figure 1:
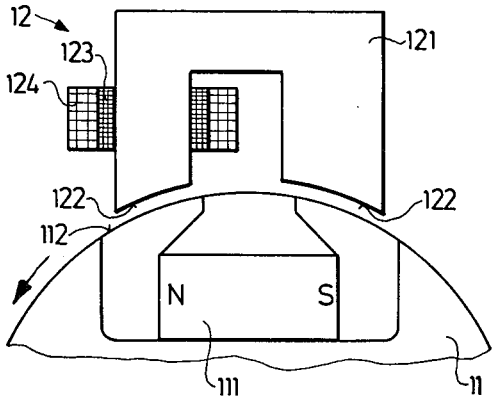
FIG. 1 is a schemmatic representation of the ignition armature of a first embodiment of the invention, utilizing an asymmetric U-shaped ferromagnetic core.

FIG. 1 shows schemmatically the basic structure of a magneto generator driven by the internal combustion engine. The revolving pole wheel rotor 11 carries a U-shaped permanently magnetized magnet system 111 comprising a permanent magnet having poles marked N and S and pole pieces having pole faces 112. Once in every revolution of the rotor 11 the pole surfaces 112 stand opposite the pole surfaces 122 of the ignition armature 12, which are of unequal size, the armature 12 in this case having an asymmetric U-shaped ferromagnetic core 121, which may be made of soft iron. The core 121 carries a primary winding 123 and a secondary winding 124 on one of its legs (the narrower leg).

Figure 2:
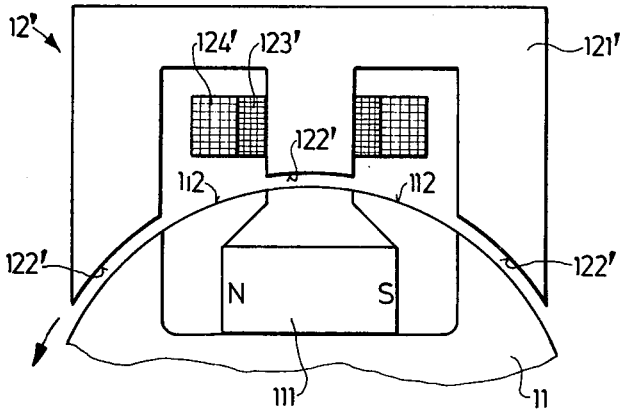
FIG. 2 is a schemmatic representation of the ignition armature of a second embodiment of the invention, utilizing a symmetrical E-shaped ferromagnetic core.

FIG. 2 similarly shows the analagous construction of an ignition armature 12' having a symmetrical E-shaped ferromagnetic core 121', the primary winding 123' and the secondary winding 124' in this case being carried on the middle leg of the armature core.

Figure 3:
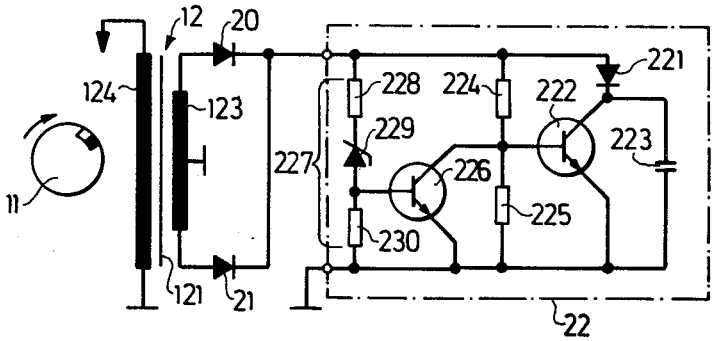
FIG. 3 is a circuit diagram of an ignition system utilizing an ignition armature according to either FIG. 1 or FIG. 2.

In the illustrative embodiment of the invention in an ignition system shown by the circuit diagram given in FIG. 3, the primary winding 123 of the ignition armature 12 is provided with a center tap grounded to the chassis and the two ends of the primary winding 123 are connected respectively over the rectifier diodes 20 and 21 to a common connection 24 of an electronic circuit unit 22, which also has a terminal 25 grounded to the chassis. The common connection point 24 for the diodes 20 and 21 provided in the electronic circuit unit 22 is connected over an additional diode 221 and the collector-emitter path of an ignition transistor 222 to the chassis ground. A protecting capacitor 223 is connected in parallel with the collector-emitter path of the ignition transistor 222. The connection point 24 is also connected to the chassis ground over a voltage divider consisting of the two resistors 224 and 225, the common connection of which (the tap of the divider) is connected both to the base of the ignition transistor 222 and to the collector of a control transistor 226. The emitter of the control transistor 226 is grounded. The connection point 24 is also connected ultimately to ground over a voltage divider 227 which consists of a resistor 228, a Zener diode 229 and another resistor 230. The common connection of the Zener diode 229 and the resistor 230 is connected to the base of the control transistor 226.

OPERATION OF THE CIRCUIT OF FIG. 3

Voltage half waves induced in the primary winding of the armature 12 by the rotation of the rotor 11 are alternately rectified by the rectifier diodes 20 and 21. During a positive voltage half wave so produced, a positive potential is applied to the base of the ignition transistor 222 by the voltage divider 224, 225. The ignition transistor 222 is then caused to conduct and the primary winding 123 is then short circuited over the diode 221 and the collector-emitter path of the ignition transistor 222. The diode 221 serves to block reverse current.

At the same time the positive voltage half wave produced in the primary winding 123 is applied to the voltage divider 227. No current flows, at least at first, however, because it is blocked by the Zener diode 229. At the time for ignition the Zener voltage is reached as the voltage across the Zener diode increases, and the Zener diode then conducts. A positive potential is then applied to the base of the control transistor 226, putting the latter into its conducting condition and grounding the base of the ignition transistor 222, which then suddenly is put into its nonconducting condition. The current of the primary winding 123 is thereby instantly interrupted, causing a high voltage to be induced into the secondary winding 124, which produces a spark at a spark plug symbolically represented by the arrowhead 125.

Figure 4:
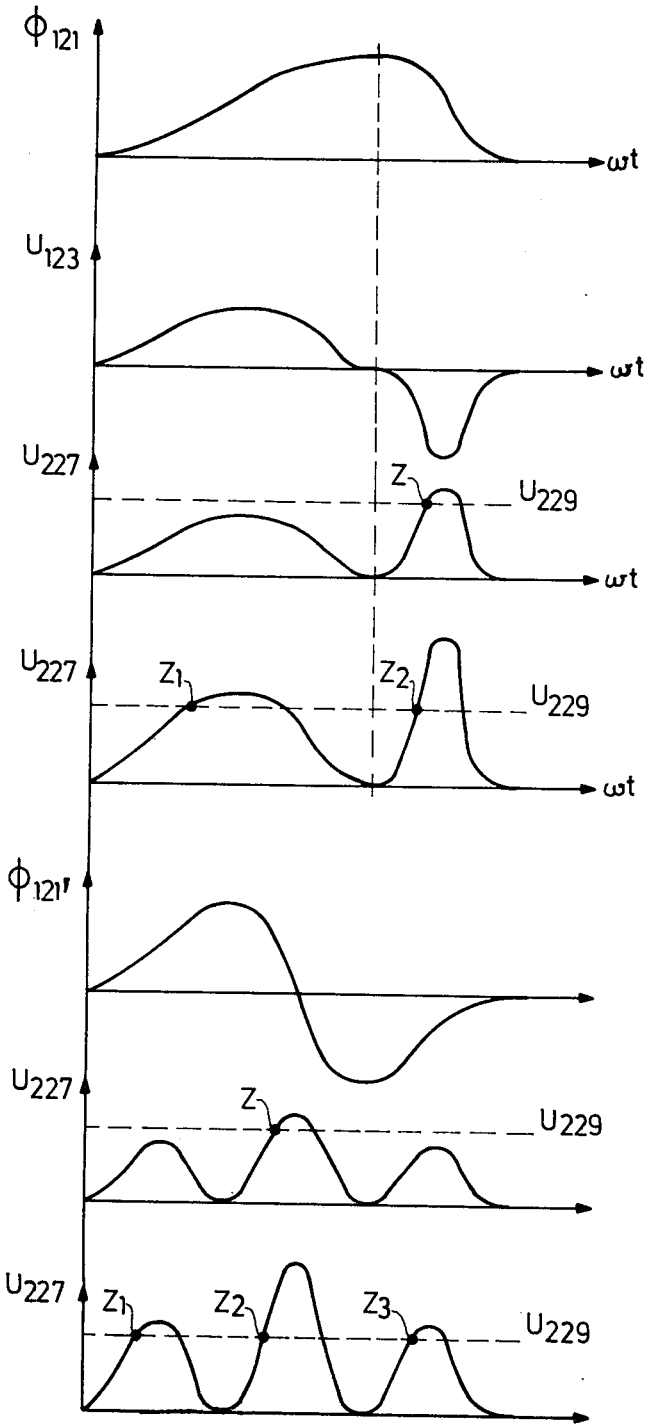
FIG. 4 is a timing diagram showing the time relation of the magnetic flux and the voltages in the embodiments of FIGS. 1–3.

The effects of the particular configuration of the armature cores shown in FIGS. 1 and 2 are made clear by the curves plotted in FIG. 4. The uppermost of these timing diagrams shows the course of the magnetic flux density in the asymmetric ferromagnetic core 121 shown in FIG. 1. during the part of the engine cycle which is of interest. The next diagram down shows the voltage induced by that flux in the primary winding 123. During the at first gradually rising and later steeply falling off magnetic flux, the induced positive voltage half wave shows up flatter and more spread out than the succeeding negative half wave.

The next curve down (third diagram) shows the voltage rectified by the diodes 20 and 21, as applied to the voltage divider 227. The respresentation shows the conditions at low engine speed, where the first voltage half wave has insufficient amplitude to break down the Zener diode 229. Ignition accordingly occurs only at the time T, during the progress of the second half wave.

The fourth diagram shows the effect of the conditions at high engine speed. The greater induced voltage obtained at higher speeds enable the first half wave also to reach the breakdown voltage of the Zener diode 229 and two ignition pulses are produced, and the time of ignition is suddenly shifted forward (spark advance) at a certain speed when this first happens, that is, when the earlier positive half wave first causes a spark to be produced. The spark advance effect enables the engine to operate at more nearly optimum conditions of operation. The double spark pulse, moreover, provides for a more effective combustion of the fuel mixture.

The fifth diagram shows the magnetic flux density when the symmetrical E-shaped ferromagnetic core 121' shown in FIG. 2 is used. The magnetic flux now has a positive and a negative half wave. At the transition from the positive to the negative half wave, there is a sharp change in the flux. The diagram shown immediately below (sixth diagram) shows the voltage induced in the primary winding 123, as rectified by the diodes 20 and 21 and applied to the voltage divider 227. Three half waves appear, of which the middle one which comes during the greater change of flux has the higher voltage. At lower engine speeds, only the middle voltage half wave can break down the Zener diode 229 and cause a spark to be produced.

The bottom (seventh diagram) shows the conditions at higher speed. The Zener diode 229 is now broken down by each voltage half wave, the ignition time is advanced and the occurrence of three sparks makes possible a still better combustion of the fuel mixture.

Figure 5:
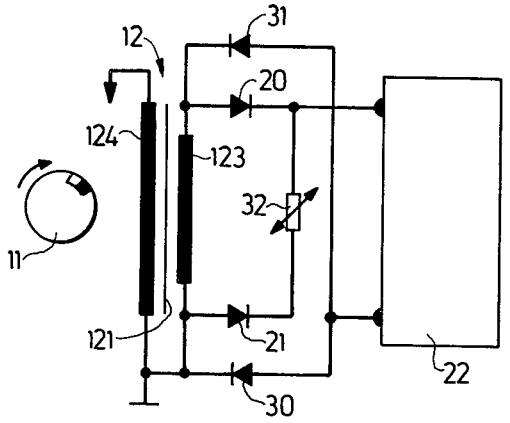
FIG. 5 is a circuit diagram of an ignition system according to the invention utilizing electronic damping of the first voltage half wave.

In the second illustrative embodiment of a circuit, shown in FIG. 5, for use in an ignition system according to the invention, a primary winding 123 without a center tap is used on the ignition armature 12 of the magneto generator. A full wave bridge circuit, adding two more diodes 30 and 31 to the rectifier diodes 20 and 21, is accordingly used and the output of the bridge is supplied to the electronic circuit unit 22, the return side of which is now grounded through the diode 30 rather than grounded directly as in FIG. 3. The primary winding 123 now has one end connected to one end of the secondary winding 124, with this common connection grounded to the chassis. In the circuit of FIG. 5 one half wave path of the rectifier, in this case the path containing the diodes 31 and 21, has a voltage dependent resistor 32 inserted in the path for the reason that will presently be explained.

OPERATION OF FIG. 5 CIRCUIT

Figure 6:
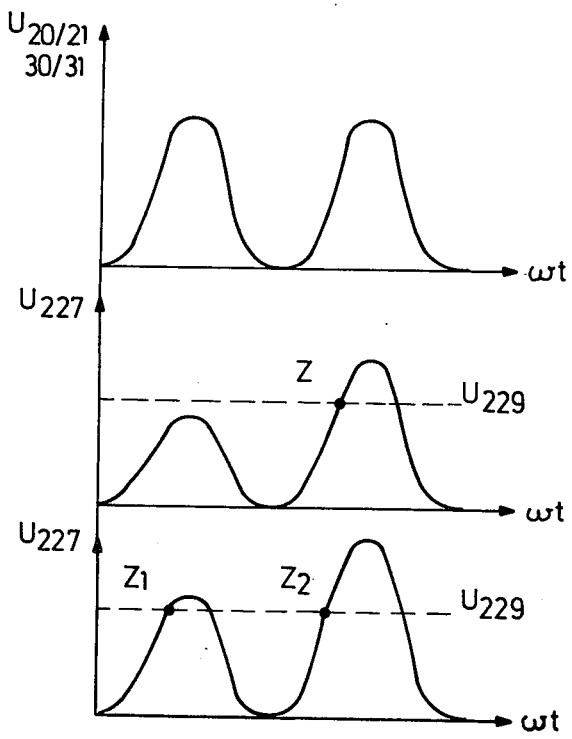
FIG. 6 is a timing diagram relating to the circuit of FIG. 5 used with a symmetrical U-shaped ferromagnetic armature core.

For the case where the armature 12 has a symmetrical U-shaped ferromagnetic core 121, the behavior of the circuit of FIG. 5 is described in FIG. 6. The top diagram shows the voltage induced in the primary winding 123 as rectified by the four diodes 20,21, 30 and 31. The second diagram shows the voltage applied to the voltage divider 227. The first voltage half wave is damped by the voltage dependent resistor 32 and at low speeds does not reach the breakdown voltage of the Zener diode 229. Ignition therefore occurs only during the second half wave. The third diagram shown just below, as in FIG. 4, shows the conditions at a higher speed at which a sudden advance of the spark and a doubled ignition pulse appear. For the reduction of the amplitude of the first voltage half wave, instead of the voltage dependent resistor 32, there could also be used a succession of diodes, which may be referred to as a diode path, or a Zener diode.

Although the invention has been described with respect to particular embodiments, it will be understood that variations and modifications may be made within the inventive concept. For example, the circuit of FIG. 5, the operation of which has been described in connection with the use of a symmetrical U-shaped armature core, can also be used with an asymmetric U-shaped armature core or with a symmetrical E-shaped armature core. Since the geometrical configuration of the latter two types of armature cores already produces a reduction of the amplitude of the first voltage half wave induced in the primary winding, then, as previously described, when the circuit of FIG. 5 is used with one of them it serves to provide supplementary damping further reducing the amplitude of the first voltage half wave, just as would also be provided by placing a damping element in circuit with the diode 21 of FIG. 3.

We claim:

1. An ignition system for an internal combustion engine comprising:

a magneto generator driven by the engine and having an ignition circuit armature and windings thereon wound in the form of a built-in spark coil comprising primary and secondary windings;

at least one spark plug connected in circuit with said secondary winding;

electronic circuit means, connected in parallel with at least part of said primary winding and including full wave rectifying means for rectifying the output voltage of said primary winding, said electronic circuit means including also the switching path of a semiconductor switch arranged in series with a similarly poled diode in a circuit branch substantially short-circuiting said primary winding through said rectifying means except when said semiconductor switch is turned off by a control pulse on a control electrode thereof, said electronic circuit means further including a transistor (226) responsive to the voltage across the combination of said switching path and said similarly poled diode for producing a control pulse and applying it to said control terminal of said semiconductor switch when said voltage exceeds a predetermined voltage, said transistor having its switching path connected in parallel to the control path of said semiconductor switch and having its control electrode connected to a voltage divider energized by the output of said rectifying means and further including a Zener diode (229) so connected that the control path of said transistor (226) is not energized until the output of said rectifying means overcomes the breakdown threshold of said Zener diode (229), and means for reducing the amplitude of the first of a succession of at least two voltage half waves produced in said primary winding as rectified by said rectifying means, relative to the second of said half waves, said amplitude reducing means including loading, by electrical resistance, of the half wave path of said rectifying means for said first voltage half wave, so that said first voltage half wave of said succession has a lower peak voltage than the immediately succeeding voltage half wave, whereby at low speeds of said engine, said shortcircuiting circuit branch is not interrupted during said first voltage half wave of said succession, but is interrupted by the second voltage half wave of said succession.

2. An ignition system according to claim 1, in which said primary winding (123) of said armature (12,12′) has both ends connected over a diode path (20,21,30,31) of said rectifying means to said electronic circuit means (22) and in which said amplitude reducing means includes damping means (32) in circuit with one half wave path of the diodes (21,31) of said rectifying means.

* * * * *